US010215361B1

(12) United States Patent
McCann

(10) Patent No.: US 10,215,361 B1
(45) Date of Patent: Feb. 26, 2019

(54) SHADE FOR A HEADLAMP

(71) Applicant: Jonathan McCann, Victor, NY (US)

(72) Inventor: Jonathan McCann, Victor, NY (US)

( * ) Notice: Subject to any disclaimer, the term of this patent is extended or adjusted under 35 U.S.C. 154(b) by 0 days.

(21) Appl. No.: 15/819,949

(22) Filed: Nov. 21, 2017

Related U.S. Application Data

(63) Continuation-in-part of application No. 15/714,437, filed on Sep. 25, 2017.

(51) Int. Cl.
*F21V 3/06* (2018.01)
*F21V 9/08* (2018.01)
*F21V 21/084* (2006.01)

(52) U.S. Cl.
CPC ..... *F21V 3/0625* (2018.02); *F21V 9/08* (2013.01); *F21V 21/084* (2013.01)

(58) Field of Classification Search
None
See application file for complete search history.

(56) References Cited

U.S. PATENT DOCUMENTS

2016/0091184 A1* 3/2016 Ng ..... A45F 3/20 362/101

* cited by examiner

*Primary Examiner* — Kristy A Haupt
(74) *Attorney, Agent, or Firm* — Woods Oviatt Gilman LLP; Katherine H. McGuire, Esq.

(57) ABSTRACT

A shade for removable attachment to a headlamp assembly having a headlamp connected to a head-strap where the shade is formed from first and second flexible, translucent wall panels which may lay flat against each other when not in use. The shade includes notches formed in each wall panel to which the segments of the head-strap located on either side of the headlamp may be removably connected. The headlamp assembly and shade when connected together may be suspended from a fixed point or placed upon a flat surface thereby creating a hands-free lantern.

10 Claims, 10 Drawing Sheets

SHADE FOR A HEADLAMP

BACKGROUND OF THE INVENTION

The present invention relates to a removable shade for a headlamp which incorporates a strap for attaching the headlamp to the user's head about the forehead. Headlamp assemblies are commonly used for hiking and camping but may be utilized for any activity where a light source is required. The headlamp assembly frees the user's hands and is therefore typically more desirable than a flashlight or hand held lantern.

It is sometimes desired to adjust the brightness of the headlamp, for example, lowered, filtered and/or otherwise provided in a color and intensity that is different that the lamp source itself. A removable shade which a user may attach to the headlamp assembly to create the desired lighting effect is therefore desirable. Such removable light shades may furthermore be configured to allow the user to sit the headlamp assembly upon a flat surface or hang it from a fixed point (e.g., a hook), in either case thereby converting the headlamp assembly into a lantern. While various headlamp assembly shades have been proposed, most have a non-flexible housing and are not convenient to carry as an accessory, especially when camping or hiking when packing space, and hence packing load, is desired to be kept to a minimum.

SUMMARY OF THE INVENTION

The present invention addresses the above needs by providing in a first aspect a removable shade for a headlamp assembly having a headlamp attached to a head strap. The removable shade is preferably made from a light diffusing, sturdy yet flexible material such as polypropylene, for example. The shade is configured to include first and second wall panels which may lay over each other in a contacting, thin, flat configuration when not attached to a headlamp. As such, the shade is very easily packed into the user's carry bag or clothing pockets and does not take up much room.

In one embodiment, the removable shade is rectangular shaped with the first and second panels being closed along three sides thereof. The fourth side is open and provides an opening wherethrough the headlamp may be removably inserted in between the first and second panels. The fourth side further preferably includes first and second notches cut or otherwise formed in the free edges of the first and second panels, respectively. In an embodiment, the notches are "T" shaped and allow first and second headband segments, which are adjacent to and located on either side of the headlamp, to be removably inserted into a respective first and second notch thereby removably securing the headlamp assembly to the shade.

In a first embodiment, the present invention provides a shade for removable attachment to a headlamp assembly comprising a headlamp connected to a head-strap where the shade is formed from first and second flexible, translucent wall panels which may lay flat against each other when not in use. The shade includes notches formed in each wall panel to which the segments of head-strap located on either side of the headlamp may be removably connected.

In another aspect, the present invention provides a method of converting a headlamp assembly having a headlamp attached to a head-strap into a shaded lantern, wherein the method comprises the steps of providing a shade having first and second flexible, translucent wall panels which may lay flat against each other when not in use, the panels having an opening leading to an interior defined by the first and second panels, the opening defined by first and second free side edges each including a notch; removably inserting first and second segments of the head-strap which are located on either side of the headlamp into the first and second notches; and inserting the headlamp into the interior of the shade between the first and second wall panels. If desired, the headlamp may be inserted into the interior of the shade first and thereafter the head-strap segments attached to the respective notches.

In this attached condition, the first and second panels are flexed outwardly and held in this position by the headlamp to form outwardly curved, first and second wall panels. The headlamp assembly with shade may thereafter be suspended from a fixed point by the head-strap, or placed upon a flat surface which is possible since the panel wall free edges in the attached condition are spaced from each other and form a stable platform for the shade.

In another embodiment which may be used for larger headlamp styles, the removable shade has a main body portion having first and second panels being closed along three sides thereof. A collar portion is connected to the main body portion along a portion of each of the first and second panels with first and second elongated openings formed between the main portion and the collar portion adjacent the opposite side edges thereof. The upper edge of the collar portion is open and provides an opening together with the main body portion wherethrough the headlamp may be removably inserted in between the first and second panels. In an embodiment, the elongated openings are configured to run parallel to the upper edge of the collar portion and allow first and second headband segments, which are adjacent to and located on either side of the headlamp, to be removably inserted into a respective first and second notch thereby removably securing the headlamp assembly to the shade.

Additional objects, advantages and novel aspects of the present invention will be set forth in part in the description which follows, and will in part become apparent to those in the practice of the invention, when considered with the attached figures.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein:

FIGS. 1A-D are perspective, top plan, front elevation and side elevation views of a first embodiment of headlamp assembly shade according to the invention, respectively;

Figure 1B:
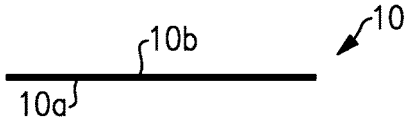
Figure 1A:
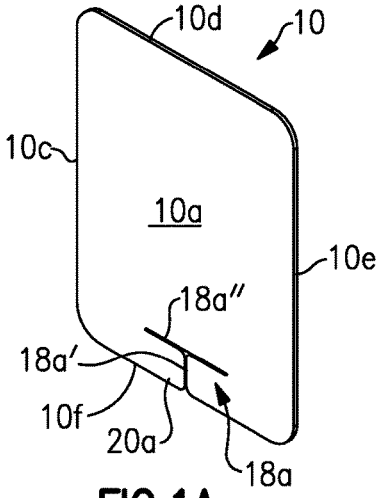
Figure 1C:
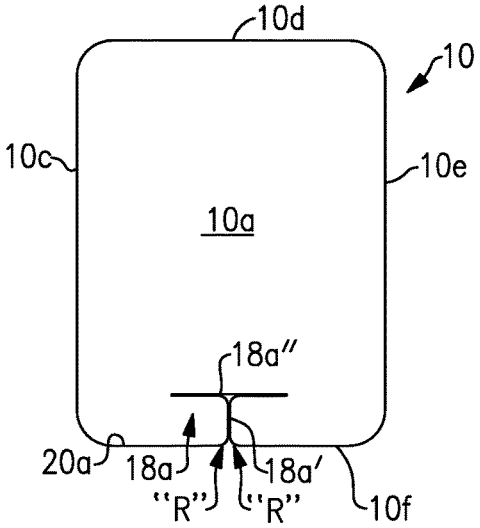
Figure 1D:
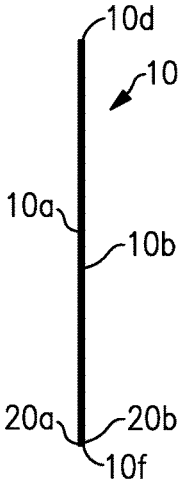
Figure 2A:
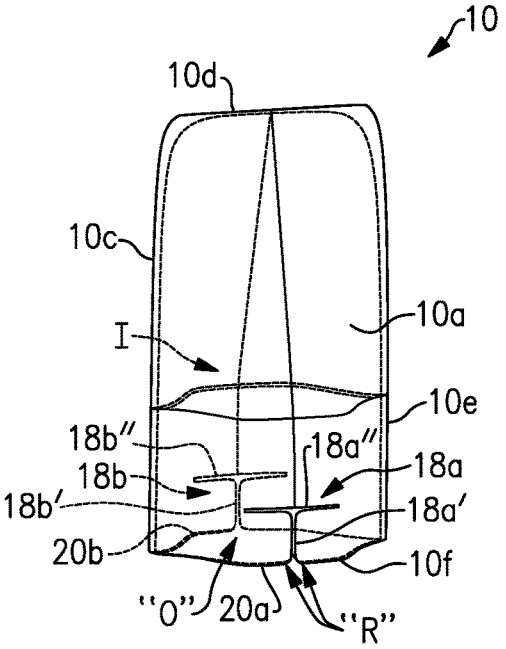
FIG. 2A is a front perspective view of the shade in the flexed condition and showing the hidden back panel wall in dashed lines.
Figure 2B:
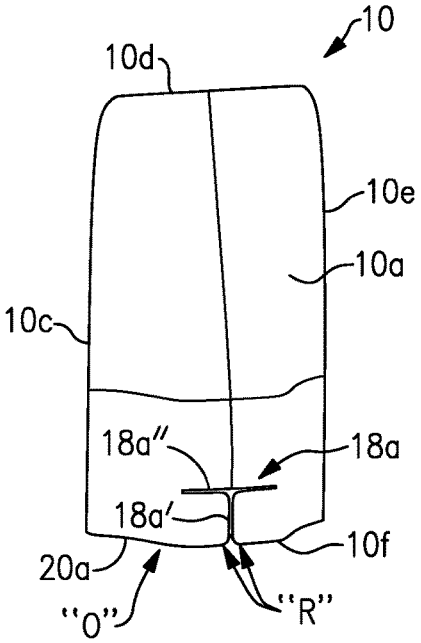
FIG. 2B is the view of FIG. 2A without showing the hidden back panel wall.
Figure 3A:
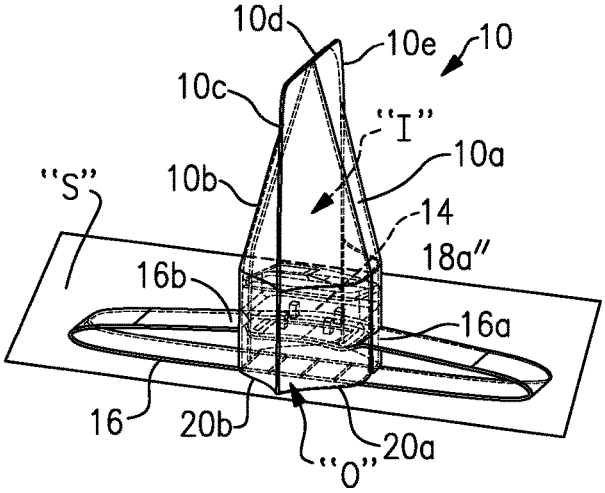
FIG. 3A is a perspective view showing the shade of FIGS. 1 and 2 removably attached to a headlamp assembly and positioned on a flat surface with the otherwise hidden shade parts and headlamp shown in dashed lines.
Figure 3B:
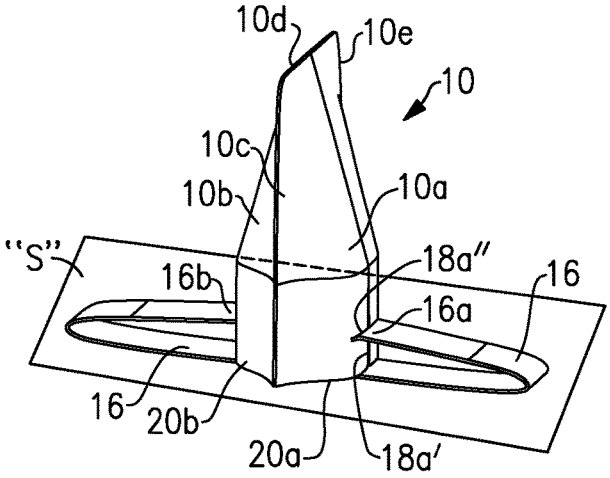
FIG. 3B is the view of FIG. 3A without showing the hidden features of the shade or headlamp.
Figure 4A:
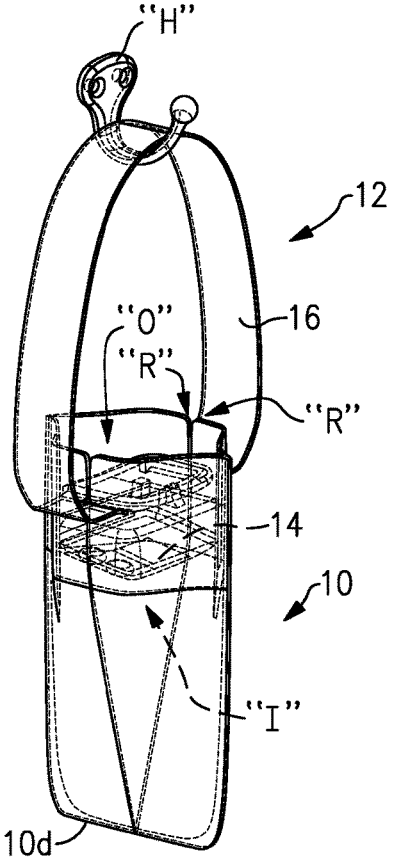
FIG. 4A is a perspective view showing the shade of FIGS. 1 and 2 removably attached to a headlamp assembly and suspended from a hook with the otherwise hidden shade parts and headlamp shown in dashed lines.
Figure 4B:
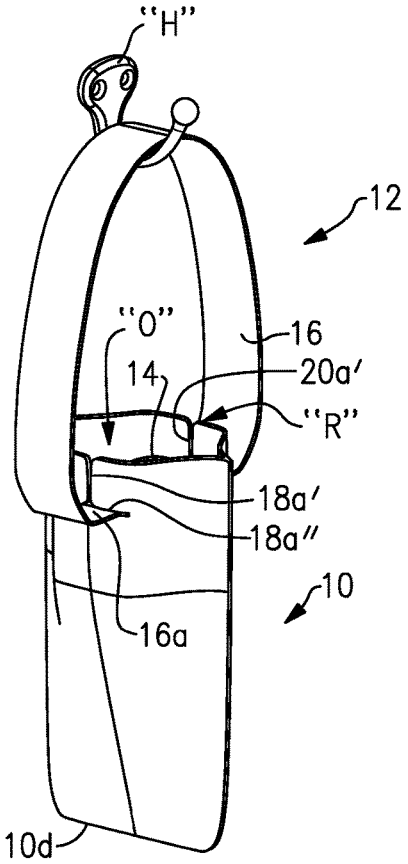
FIG. 4B is the view of FIG. 4A without showing the hidden features of the shade or headlamp or hook.
Figure 5A:
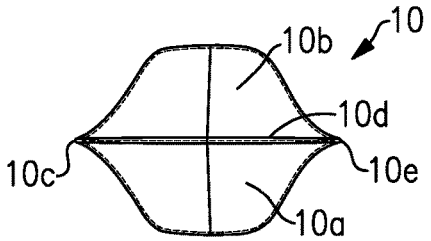
Figure 5B:
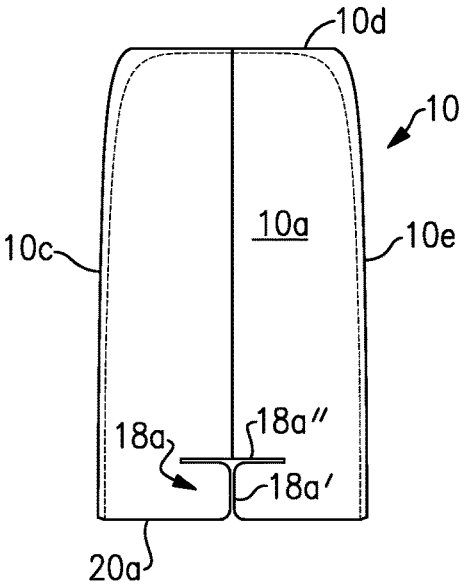
Figure 5C:
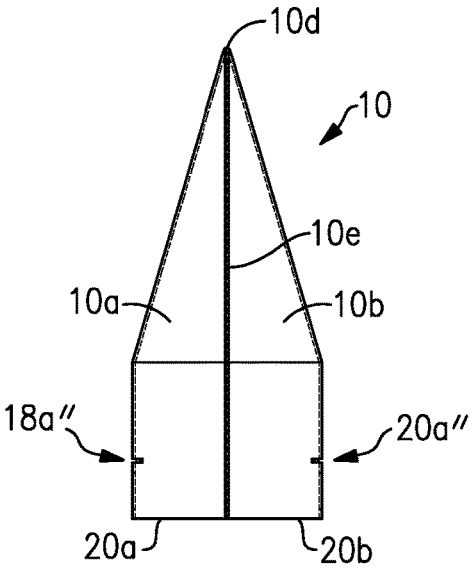
Figure 6B:
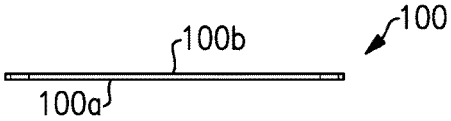
Figure 6D:
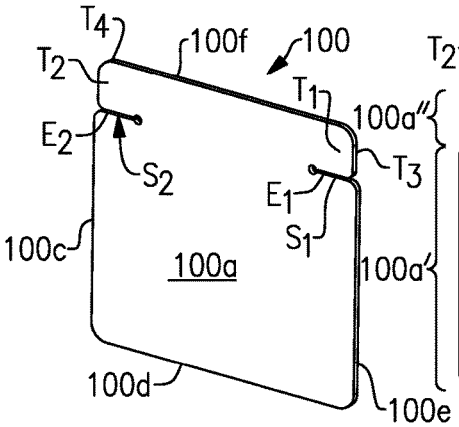
Figure 6A:
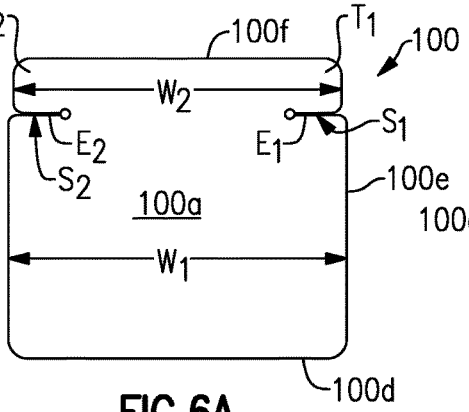
Figure 6C:
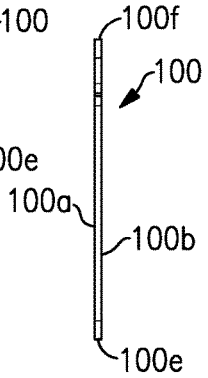
Figure 7A:
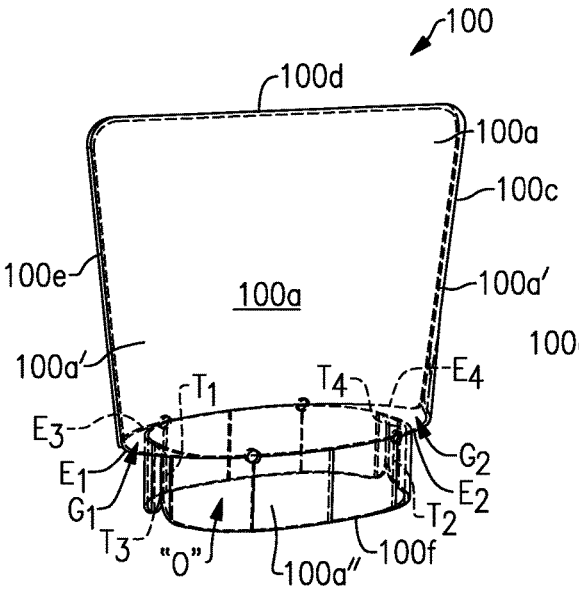
Figure 7B:
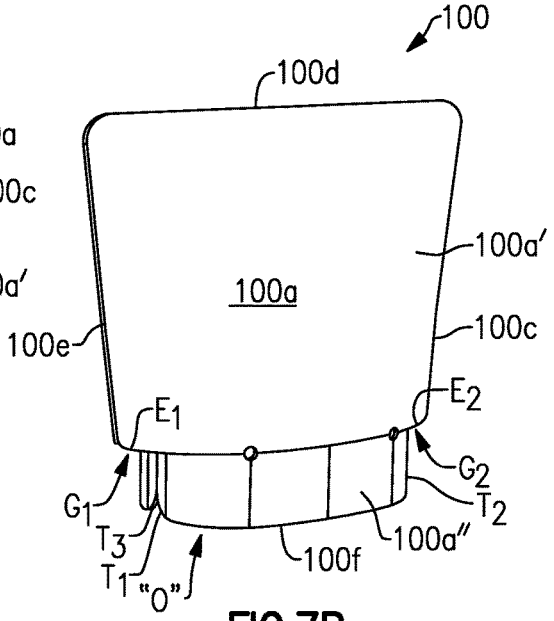
Figure 8A:
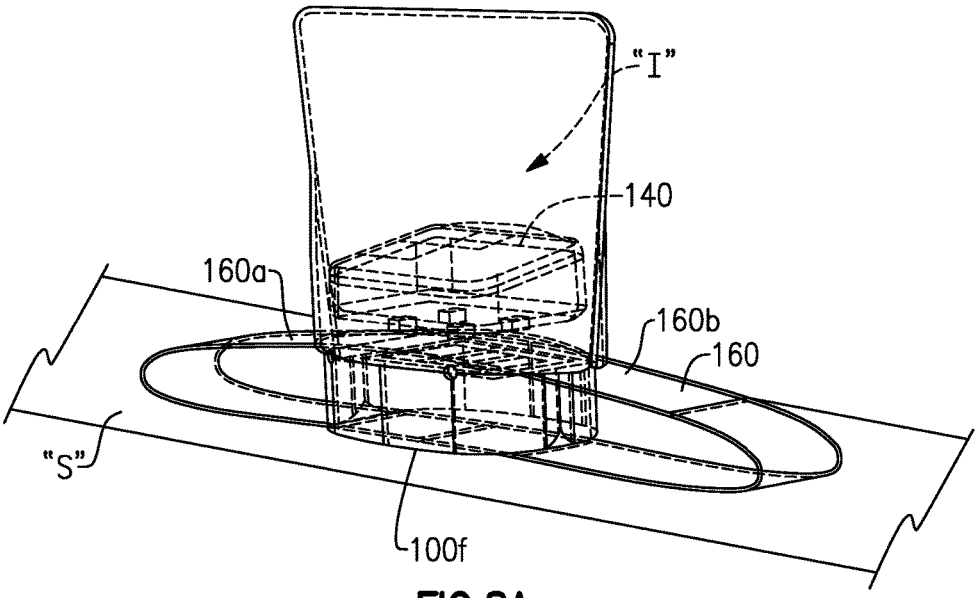
Figure 8B:
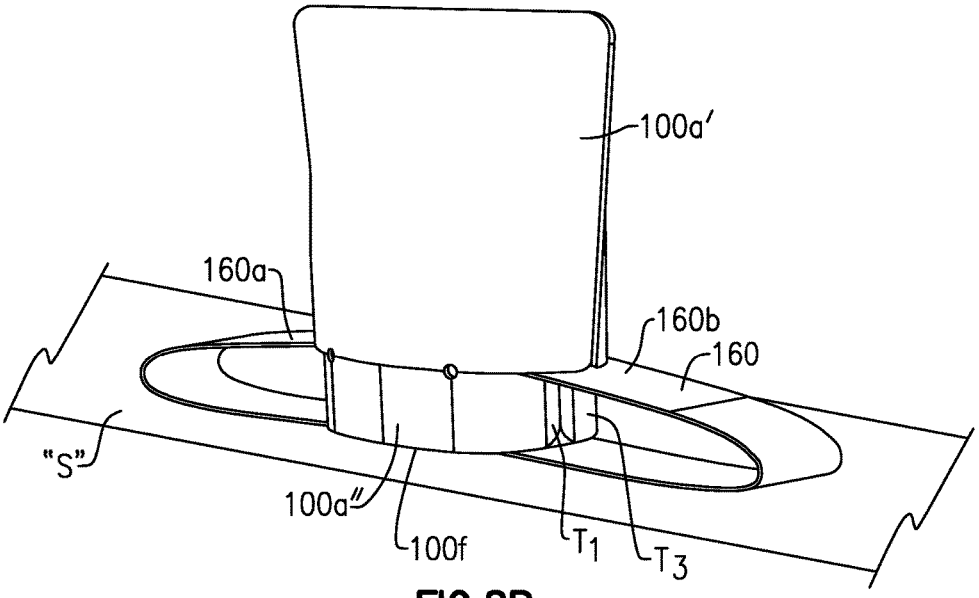
Figure 9A:
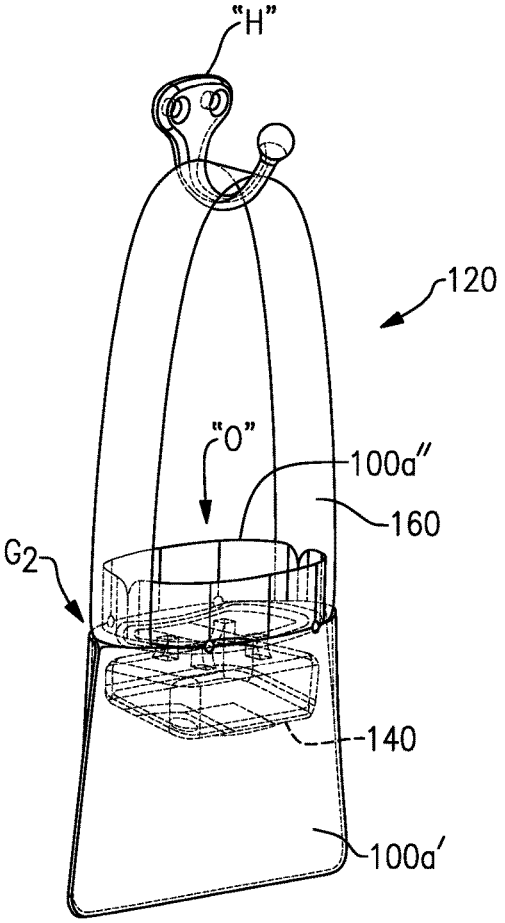
Figure 9B:
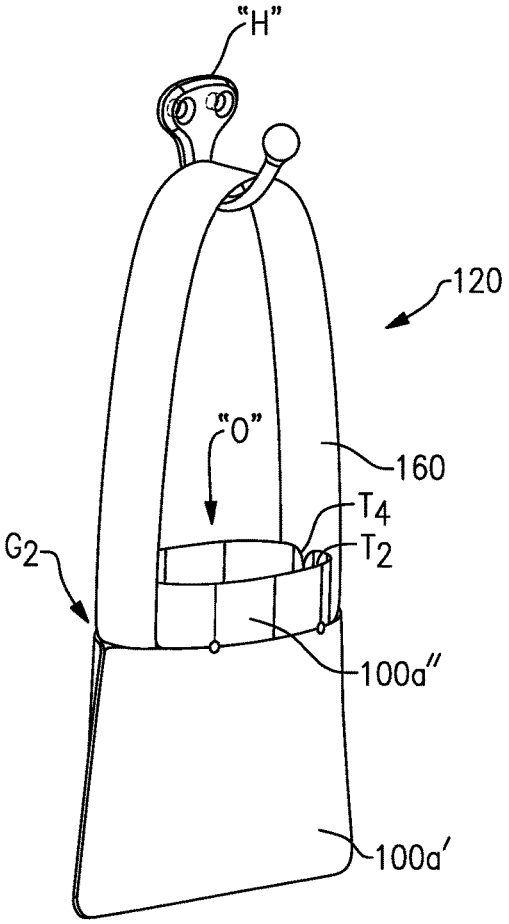
Figure 10A:
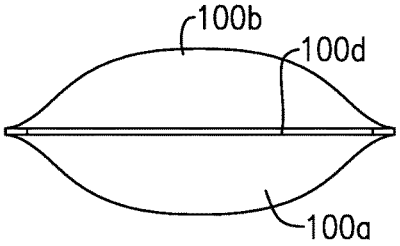
Figure 10B:
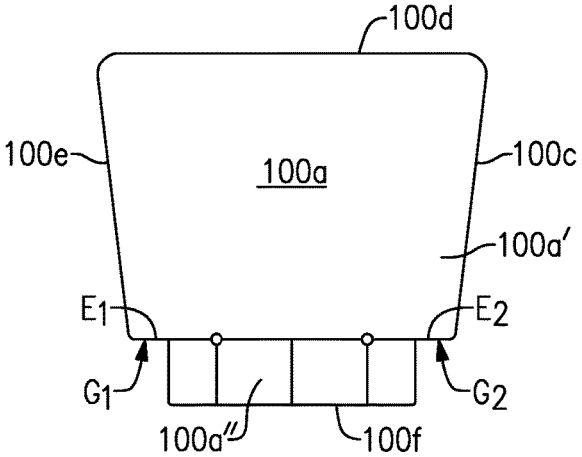
Figure 10C:
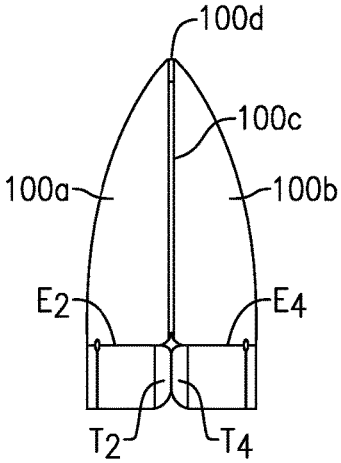

FIGS. 5A-C are front and side elevation and top plan view of the shade shown in the expanded condition;

FIGS. 6A-D are front elevation, top plan, side elevation and perspective views of another embodiment of headlamp assembly shade according to the invention, respectively;

FIG. 7A is a front perspective view of the shade in the flexed condition and showing the hidden back panel wall in dashed lines;

FIG. 7B is the view of FIG. 7A without showing the hidden back panel wall;

FIG. 8A is a perspective view showing the shade of FIGS. 6A-D removably attached to a headlamp assembly and positioned on a flat surface with the otherwise hidden shade parts and headlamp shown in dashed lines;

FIG. 8B is the view of FIG. 8A without showing the hidden features of the shade or headlamp;

FIG. 9A is a perspective view showing the shade of FIGS. 6A-D removably attached to a headlamp assembly and suspended from a hook with the otherwise hidden shade parts and headlamp shown in dashed lines;

FIG. 9B is the view of FIG. 9A without showing the hidden features of the shade or headlamp or hook; and FIGS. 10A-C are front and side elevation and top plan view of the shade of FIGS. 6A-D shown in the expanded condition;

DETAILED DESCRIPTION OF PREFERRED EMBODIMENTS

With regard to a first embodiment of the invention as shown in FIGS. 1A-5C, the present invention provides in a first aspect a removable shade 10 for a headlamp assembly 12 having a headlamp 14 attached to a head strap 16. The removable shade 10 is preferably made from a light diffusing, sturdy yet flexible material such as polypropylene, for example. The shade 10 is configured to include first and second wall panels 10*a* and 10*b* which are interconnected along at least one edge and may lay over each other in a contacting, thin, flat configuration when not attached to a headlamp 14 (see FIGS. 1A-D). As such, the shade 10 is very easily packed into the user's duffle bag, backpack or clothing pockets (not shown), and as such does not take up much room or create any appreciable added weight.

In an embodiment, the removable shade 10 may be square or rectangular shaped with the first and second panels 10*a*, 10*b* being closed along three sides 10*c*, 10*d* and 10*e* thereof. The fourth side 10*f* is open and provides an opening "O" wherethrough the headlamp 14 may be removably inserted in between the first and second panels 10*a*, 10*b*. While a four-sided configuration is shown and described herein, it is understood that other configurations are possible and within the scope of the invention including, for example, polygonal, arcuate and any combinations thereof.

The panel edges which are not interconnected (in this embodiment, fourth side 10*f*) further preferably includes first and second notches 18*a*, 18*b* cut or otherwise formed in the first and second free edges 20*a*, 20*b* of the first and second panels 10*a*, 10*b*, respectively. In an embodiment, the notches are "T" shaped with a first linear slit 18*a*', 18*b*' extending from and perpendicular to respective free edge 20*a*, 20*b*, and a second linear slit 18*a*", 18*b*" extending perpendicular to respective first linear slits 18*a*', 18*b*'. The second linear slits 18*a*", 18*b*" extend spaced and parallel to respective free edge 20*a*, 20*b* to form a "T" with first linear slits 18*a*', 18*b*'. This "T" configuration allows first and second headband segments 16*a*, 16*b*, which are adjacent to and located on either side of the headlamp 14, to be manually maneuvered into a respective first and second linear slits 18*a*', 18*b*' and thereafter manually maneuvered into respective second linear slits 18*a*", 18*b*" wherein the head-strap segments 16*a*, 16*b* reside while headlamp assembly 14 is attached to shade 10. In an embodiment, the corners of first and second slits 18*a*', 20*a*' may have rounded corners "R" adjacent free edges panel 20*a*, 20*b* to facilitate the insertion of head-strap segments 16*a*, 16*b* therein, respectively. Withdrawal of head-strap segments 16*a*, 16*b* from respective notches 18*a*, 20*b* is easily performed by performing the same attachment manual maneuver described above in reverse. Although a "T" notch configuration is shown and described herein, it is understood that notches 18*a*, 18*b* may be formed in other configurations (linear and or curved) so long as they are adapted to removably connect shade 10 to head-strap segments 16*a*, 16*b*.

In another aspect, the present invention provides a method of converting a headlamp assembly having a headlamp attached to a head-strap into a shaded lantern, wherein the method comprises the steps of providing a shade 10 having first and second, flexible, translucent wall panels 10*a*, 10*b*, respectively, which may lay flat against each other when not in use, such as seen in FIGS. 1A-D. The panels 10*a*, 10*b* have an opening "O" leading to an interior "I" defined by the first and second panels, the opening defined by first and second free side edges 20*a*, 20*b* each including a notch 18*a*, 18*b*; removably inserting first and second segments 16*a*, 16*b* of the head-strap 16 which are located on either side of the headlamp 14 into the first and second notches 18*a*, 18*b*; and inserting the headlamp 14 into the interior "I" of the shade 10 between the first and second wall panels 10*a*, 10*b*. If desired, the headlamp 14 may be inserted into the interior "I" of the shade 10 first and thereafter the head-strap segments 16*a*, 16*b* may be attached to the respective notches 18*a*, 18*b*.

In this attached condition, the first and second panels 10*a*, 10*b* are flexed outwardly and held in this position by the headlamp 14 to form outwardly curved, first and second wall panels 10*a*, 10*b* as seen in FIGS. 2A-5C. The headlamp assembly 12 with shade 10 may thereafter be suspended from a fixed point such as a hook "H" seen in FIGS. 4A, 4B by the head-strap 16, or placed upon a flat surface "S" as seen in FIGS. 3A, 3B which is possible since the panel wall free edges 20*a*, 20*b* in the attached condition are spaced from each other and form a stable platform for the shade 10.

A second embodiment of the invention is seen in FIGS. 6A-10C where the removable shade 100 having first and second panels 100*a*, 100*b* for a headlamp assembly 120 having a headlamp 140 attached to a head strap 160. The removable shade 100 is preferably made from a light diffusing, sturdy yet flexible material such as polypropylene, for example. The shade 100 is configured to include first and second wall panels 100*a* and 100*b* which are interconnected along at least one edge and may lay over each other in a contacting, thin, flat configuration when not attached to a headlamp 140 (see FIGS. 6A-D). As such, the shade 100 is very easily packed into the user's duffle bag, backpack or clothing pockets (not shown), and as such does not take up much room or create any appreciable added weight.

In an embodiment, the removable shade 100 may be generally square or rectangular shaped with the first and second panels 100*a*, 100*b* being closed along three sides 100*c*, 100*d* and 100*e* thereof. The fourth side 10*f* is open and provides an opening "O" wherethrough the headlamp 14 may be removably inserted in between the first and second panels 10*a*, 10*b*. While a four-sided configuration is shown and described herein, it is understood that other configurations are possible and within the scope of the invention including, for example, polygonal, arcuate and any combinations thereof.

The first and second panels 100*a* and 100*b* each include a main body portion 100*a*', 100*b*' and a collar portion 100*a*", 100*b*", respectively. In the embodiment shown, the collar portion and main body portion are integrally formed from the same panels 100*a*, 100*b*, although they may be made as separate pieces which are attached together during manufacturing, if desired. A seen best in FIG. 6A, the collar portions 100*a*", 100*b*" may have a width $W_2$ which is smaller than the corresponding width $W_1$ of main body portions 100*a*', 100*b*'. First and second elongated slits $S_1$ and $S_2$, which may extend spaced from and parallel to edge 100*f*, may be formed between main body portion 100*a*' and collar portion 100*a*" to form first and second adjacent collar tabs $T_1$ and $T_2$ at panel 100*a*, and third and fourth adjacent collar tabs $T_3$ and $T_4$ at panel 100*b*. The adjacent tab pairs $T_1$, $T_3$ and $T_2$, $T_4$ may be but preferably are not connected to one another. As seen best in FIGS. 6A, B and FIGS. 7A, B, slits $S_1$ and $S_2$ extend through each panel 100*a* and 100*b* and thereby form front and back panel unconnected free edges $E_1$ and $E_3$, respectively, adjacent side edge 100*e*, and front and back panel unconnected free edges $E_2$ and $E_4$, respectively, adjacent side edge 100*c*.

Thus, when ready to use the shade 100 which is normally in the stored, flat condition seen in FIGS. 6A-D, a user presses inwardly along sides 100*c* and 100*e* causing panels 100*a* and 100*b* to move away from each other as seen in FIGS. 7A,B and 10A-C. In this "open" shade configuration, the adjacent tabs $T_1$ and $T_3$ may bend slightly inwardly toward each other and may or may not overlap with each other. Likewise, adjacent tabs $T_2$ and $T_4$ may bend slightly inwardly toward each other and may or may not overlap with each other. Due to collar portion 100*a*" not being as wide as main body portion 100*a*', when moved to the open shade configuration described above, first and second crescent shaped gaps $G_1$ and $G_2$ are formed at adjacent tab pairs $T_1$, $T_3$ and $T_2$, $T_4$, respectively. While holding the shade in the open configuration, the user passes the headlamp light 140 through opening "O" into the interior "I" of shade 100 between first and second panels 100*a*, 100*b*. First and second headband segments 160*a*, 160*b* are passed between adjacent tabs $T_1$, $T_3$, and $T_2$, $T_4$, respectively, until they extend through gaps $G_1$ and $G_2$, respectively. Withdrawal of head-strap segments 160*a*, 160*b* from respective gaps $G_1$ and $G_2$ is easily performed by performing the same attachment manual maneuver described above in reverse. It is noted that although slits $S_1$ and $S_2$ are formed parallel to edge 100*f* and are straight and elongated as shown and described herein, it is understood that slits $S_1$ and $S_2$ may be formed in other configurations (e.g., non-parallel, angled or curved) so long as they are adapted to removably connect shade 100 to head-strap segments 160*a*, 160*b*.

In this attached condition, the first and second panels 100*a*, 100*b* are flexed outwardly and held in this position by the headlamp 140 to form outwardly curved, first and second panels 100*a*, 100*b* as seen in FIGS. 8A-10C. The headlamp assembly 120 with shade 100 may thereafter be suspended from a fixed point such as a hook "H" seen in FIGS. 9A, 4B by the head-strap 160, or placed upon a flat surface "S" as seen in FIGS. 8A, 8B which is possible since the collar portion free edges 100*f* when in the attached condition are spaced from each other and form a stable platform for the shade 100.

It will thus be appreciated that the present invention provides a shade for a headlamp assembly which allows the user to create a hands-free lantern. The shade is extremely light-weight and takes up a minimum of space when not in use such that it is easily packed and carried with other belongings (e.g., in a backpack or pocket). The shade may be provided in multiple colors so that the user may choose the desired lighting effect. The translucency of the shade panels may also be varied as desired by selecting the appropriate materials and thicknesses for the panels.

While this method and apparatus has been shown and described with reference to certain preferred embodiments thereof, it will be understood by those skilled in the art that various changes in form and details may be made therein without departing from the spirit and scope of the invention as described.

What is claimed is:

1. A removable shade for removable attachment to a headlamp assembly having a headlamp attached to a head strap, the head-strap having first and second segments located on either side of the headlamp, said shade movable between a closed and open position, said shade comprising:

a) first and second, flexible, translucent panels each having a main body portion and a collar portion, said first and second panels laying in contacting, covering relation to each other when said shade is in the closed position unattached to a headlamp assembly, said first and second panels interconnected to each other along an edge and first and second unconnected, free edges of said first and second panels defining an opening leading to an interior of said shade located between said first and second panels, said interior adapted to removably receive via said opening a headlamp of a headlamp assembly;

b) first and second elongated slits formed in spaced, parallel relation to said first and second free edges of said first and second panels, respectively, said first and second slits formed between said main body portion and said collar portion of each of said first and second panels and thereby forming first and second collar tabs at said first panel, and third and fourth collar tabs at said second panel, respectively, said first and third collar tabs located adjacent one another and said second and fourth collar tabs located adjacent one another, wherein, upon moving the shade to the open position, said first and second segments of the head-strap are adapted to removably pass through first and second gaps formed at said adjacent first and third collar tabs, and at said adjacent second and fourth collar tabs, respectively, to attach said headlamp to said shade.

2. The removable shade of claim 1 wherein said collar portions are unattached to said main body portions and each have a width which is smaller than the corresponding width of said main body portion of each of said first and second panels, respectively.

3. The removable shade of claim 2 wherein said shade is rectangular shaped defined by first, second, third and fourth edges with said first, second and third edges being closed and said fourth edge being open.

4. The removable shade of claim 1 wherein said first and second panels are formed of polypropylene.

5. The removable shade of claim 1 wherein said shade is colored.

6. A method of converting a headlamp assembly to a shaded hands-free lantern, said headlamp assembly having a headlamp attached to a head strap, the head-strap having first and second segments located on either side of the headlamp, said method comprising the steps of:

a) providing first and second, flexible, translucent panels each having a main body portion and a collar portion, said first and second panels laying in contacting, covering relation to each other when said shade is unattached to a headlamp assembly, said first and second panels interconnected to each other along an edge and first and second unconnected, free edges of said first and second panels defining an opening leading to an interior of said shade located between said first and second panels, said interior adapted to removably receive via said opening a headlamp of a headlamp assembly;

b) forming first and second elongated slits between said main body portion and said collar portion of each of said first and second panels, said slits extending in spaced, parallel relation to said first and second unconnected, free edges of said first and second panels, said first and second slits forming first and second collar tabs at said first panel, and third and fourth collar tabs at said second panel, respectively, said first and third collar tabs located adjacent one another and said second and fourth collar tabs located adjacent one another;

c) removably attaching said shade to a headlamp assembly by manually maneuvering said first and second strap segments through first and second gaps formed at said adjacent first and third collar tabs, and at said adjacent second and fourth collar tabs, respectively, and inserting said headlamp into said interior.

7. The method of claim 6 wherein said collar portions are unattached to said main body portions and each have a width which is smaller than the corresponding width of said main body portion of each of said first and second panels, respectively.

8. The method of claim 7 wherein said shade is rectangular shaped defined by first, second, third and fourth edges with said first, second and third edges being closed and said fourth edge being open.

9. The method of claim 6 wherein said first and second panels are made of polypropylene.

10. The method of claim 6 wherein said first and second panels are colored.

* * * * *